US006003988A

United States Patent [19]

McCann et al.

[11] Patent Number: 6,003,988

[45] Date of Patent: Dec. 21, 1999

[54] PRINTER ARCHITECTURE

[75] Inventors: James D. McCann, Waynesville; David F. Tunmore, Xenia, both of Ohio

[73] Assignee: Scitex Digital Printing, Inc., Dayton, Ohio

[21] Appl. No.: 08/996,933

[22] Filed: Dec. 23, 1997

[51] Int. Cl.[6] ..... B41J 2/01

[52] U.S. Cl. ..... 347/101; 226/189; 347/102; 347/104; 399/384

[58] Field of Search ..... 226/189; 347/43, 347/101, 102, 104; 399/384, 388, 397, 298; 101/219, 228, 232

[56] References Cited

U.S. PATENT DOCUMENTS 4,785,734 11/1988 Kawana et al. ..... 101/228

5,729,817 3/1998 Raymond et al. ..... 399/384

*Primary Examiner*—Sandra Brase
*Assistant Examiner*—William A. Noē
*Attorney, Agent, or Firm*—Barbara Joan Haushalter

[57] ABSTRACT

An electronic printing system comprises a substrate supply for supplying a substrate along a paper path configured in an arc. The substrate is controllably transported through the electronic printing system past a plurality of printheads. The printheads are arranged above the paper path, in an arc configuration corresponding to the paper path configuration. As the substrate passes under each printhead, a printed image is generated on the substrate. A plurality of rollers are arranged to have at least one roller under the substrate at each location corresponding to a printhead location. Finally, a dryer is located after the last of the plurality of printheads for fixing the printed image to the substrate.

10 Claims, 1 Drawing Sheet

PRINTER ARCHITECTURE

TECHNICAL FIELD

The present invention relates to electronic printing systems and, more particularly, to the architecture of high speed web presses for electronic printing.

BACKGROUND OF THE INVENTION

Electronic printing includes all ink jet printing, such as continuous ink jet printing, and all other systems wherein images are dried to fix the image on the substrate, as well as ionography, electrophotography, and all other systems wherein toner is fused to fix the image on the substrate. Current large scale electronic printing presses, typified by the Scitex 3500/3600 family, manufactured by Scitex Digital Printing, Inc., of Dayton, Ohio, are configured with a standard fuser/fixer or fixer/dryer system and are capable of drying at high speed, and full width.

The design of a typical fixer/dryer is very much related to the designs of fixers in general use in the printing industry. Typically, dryers are purchased as standard configurations, which are available with few options. They can be used at lower power if they are to be used at low speed, but standard products are generally not modular in the sense to be described below.

Conventional printing presses arrange all the apparatus for printing in a tower. Paper is fed to the tower by appropriate paper feeding apparatus using either sheets of paper, or a continuous web of paper. Typical color printing presses utilize multiple "towers". The paper is fed sequentially from one tower to the next, each tower printing a particular color (or sometimes a transparent coating). For printing processes which require fixing of one color ink before the next color ink is printed, a standard fixer/dryer is used between towers.

When it is desired to print on both sides of a substrate, there are several options in common usage. In one common web press configuration the first side is printed in a first tower and then a second tower is used for printing on the reverse side. In this type configuration, a turnbar is required between towers. A turnbar is an arrangement of rollers which have the effect of inverting the web so that the unprinted side of the paper is available for printing in a subsequent tower. Typically, at least four colors are needed on each side of the paper, so either four towers (in offset presses that can print on both sides of the paper at each tower) or eight towers (such as in cases where the print heads cannot operate upside down) are required. Obviously, the result is a long printing press, especially if dryers are required between print impressions. Long printing presses have associated problems which include excessive floor space requirements and, for digital printing systems, excessive data memory requirements.

Furthermore, in a multi-color printing process, such as a 4-color process, it is necessary to print black, cyan, magenta and yellow on paper with an accuracy of 1 pixel (1/240th of an inch), or better, anywhere on a 17"×34", or larger, image. Although conventional printing processes have minimal added moisture due to printing, certain ink jet processes introduce noticeable moisture content, particularly when using multiple colors for printing. Furthermore, dimensional characteristics of the paper adversely affect image quality. Paper expands and contracts due to its moisture content in a non-isotropic manner with lots of hysteresis. Although drying can be used to remove moisture, if dryers are used between each color printed, large dimensional changes to the paper, or substrate "stretch" or "shrink", can occur, again adversely affecting image quality. Since paper responds nearly instantaneously to the addition or removal of water, "good" printing of multiple colors has to be done in just a few seconds.

It is seen, then that there is a need for an improved electronic printing architecture which overcomes the problems associated with prior art electronic printing system architectures, and, in particular, can be applied to a digital color press printing system.

SUMMARY OF THE INVENTION

This need is met by the present invention wherein a system with a short paper path between the first and last colors is provided. Printing of all of the multiple colors is achieved before any drying is necessary. Furthermore, the web contacts the rollers under each print head to maintain the proper distance between the substrate and the jets.

In accordance with the present invention, a system with paper moving along an arc has been proposed. The arc keeps the paper against each roller, allows a short paper path, while avoiding severe angles for print head operation. It is also very simple, easy to web, and allows direct access to the print heads.

It is an object of the present invention to improve the architecture of an electronic printer so that multiple color printing can be achieved with excellent image quality results. It is an advantage of the present invention that such a system allows direct access to the print heads.

Other objects and advantages of the invention will be apparent from the following description and the appended claims.

DETAILED DESCRIPTION OF THE INVENTION

The present invention is described in detail with particular reference to certain preferred embodiments thereof, but it will be understood that modifications and variations can be effected without departing from the spirit and scope of the invention.

Figure 1:
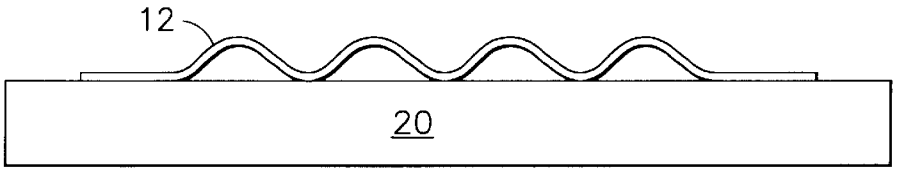
FIG. 1 illustrates the undesirable phenomenon of paper wrinkle.

As paper absorbs water-based inks, it attempts to expand in the cross-direction. When the paper is wrapped around a roller, the outer (unprinted) edges attach to the roller, but the rest of the web expands outwardly. This leads to a "buckling" of the paper between the firmly attached edges, creating lengthwise ripples or wrinkles, as illustrated in FIG. 1.

Wrinkling occurs when a web expands in the cross-web direction, but is prevented from doing so because it is held at the edges, such as on a roller. In operating a multi-color printing system, this problem becomes even more prevalent than "offset" or unwanted transfer of the ink to the rollers.

In high speed web presses for electronic printing, a substrate with a printed image, as it passes through a drier, shrinks in the cross direction. Thus, subsequent colors or images print on a narrower image than originally printed (on the non-shrunk substrate), and image mismatch occurs. Unfortunately, since the error is typically in the cross direction, the image mismatch is nearly impossible to correct by any combination of software and/or electronic manipulation.

An additional problem with printing, particularly multi-color printing, is color-to-color bleed. Bleed occurs when the 2nd, 3rd, or 4th colors are hitting on wet areas of the previous inks, causing mottle or feathering. Inter-station drying has been applied to achieve both de-wrinkling of the paper and bleed avoidance. However, although drying can be used to remove moisture, if dryers are used between each color printed, large dimensional changes to the paper, or substrate can occur, adversely affecting image quality.

In accordance with the present invention, wrinkling can be avoided if the printing process is done quickly, and the paper path does not have tight wraps on small diameter rollers. The drying is then done after all printing, preferably over a large diameter roller. Bleed can also be avoided without inter-station driers, if care is taken to put down only the amount of ink needed to attain the proper color.

Since paper expands very quickly when exposed to a high room humidity, measurable changes can occur in less than a minute. This phenomena is remarkably consistent for different kinds of paper. When liquid ink (often with a water content of 97%) is placed on paper, as in an ink-jet process, the changes are even more rapid. Unacceptable changes can occur in a 17" wide image in as little as three seconds.

Figure 2:
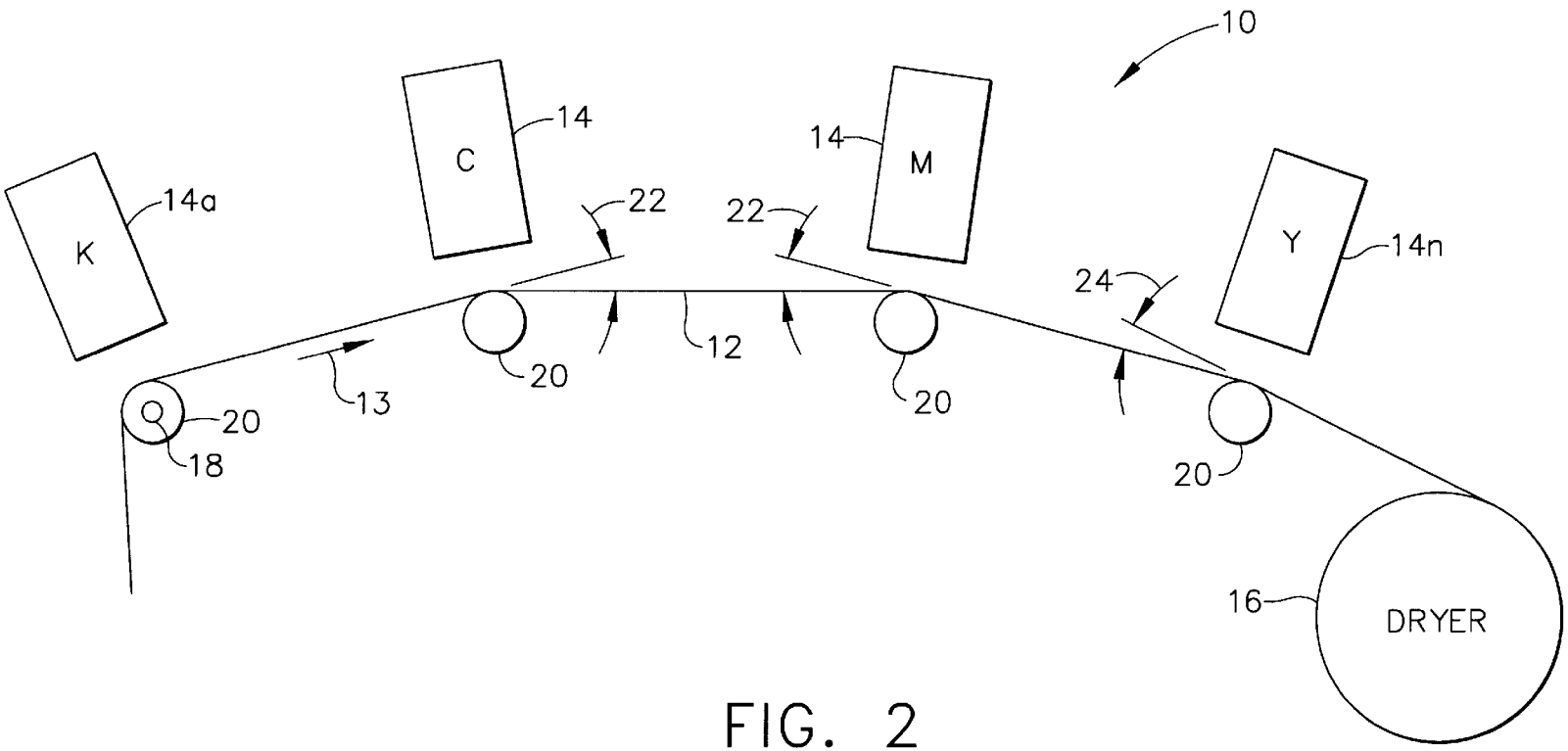
FIG. 2 illustrates a paper path and printhead configuration for the proposed printer architecture of the present invention, to prevent image quality problems, such as paper wrinkle illustrated in FIG. 1.

Referring now to FIG. 2, a paper path for a proposed printer architecture 10 is illustrated. The paperpath of substrate 12, moving in the direction of arrow 13, and the arrangement of printheads 14 are configured as an arc, with only a single drying station 16 downstream of all the printheads 14. The configuration proposed by the present invention achieves color-to-color registration of the printed image, even with multiple colors, and prints successive colors before the substrate has a chance to adversely respond to the moisture of the ink. An encoder 18 provides the taching function for all of the printheads 14.

Each printhead 14 has an associated roller 20 for maintaining satisfactory tension of the web. The rollers associated with the middle printheads, i.e., all of the printheads arranged between the first printhead 14*a* and the last printhead 14*n*, have a sufficient wrap angle 22 to supply the necessary response to friction in the roller 20. That is, the angle 22 is sufficient to break the friction on the roller, preventing the paper from sliding over the roller, and to keep the roller moving with the paper.

A large angle of wrap has several adverse effects. First, a large angle of wrap requires the heads 14 to operate at large angles from vertical, particularly as the number of printheads 14 increases. Second a large angle 22 at associated with each central printhead 14 results in a bigger arc configuration, which complicates servicing of the heads 14 and webbing of the unit 10. Finally, a particularly undesirable effect of too large a wrap angle is that it contributes to wrinkling of the substrate 12.

Conversely, a small angle is also undesirable. With too small of an angle, the substrate 12 will not be properly held against the roller 20. This will result in poor print quality, possible rubbing of the paper on the catcher, and a mismatch in printed width caused by "fluting" of the paper, where fluting is a cross web phenomenon.

Hence, in a preferred embodiment of the present invention, the wrap angle 22 is less than 45°, and more particularly, in the range of 2 to 15 degrees, and, finally, preferably approximately 4°. The minimum angle 22, therefore, is the minimum amount required to keep the roller 20 turning; and the maximum angle 22 is the maximum amount that can be achieved without paper wrinkle.

Continuing with FIG. 2, a wrap angle 24 at the last printhead 14n, where the substrate 12 enters the dryer region 16, is preferably less than 90°. The optimal wrap angle 24 can be determined in a variety of ways, such as by considering mechanical design requirements including the web entry requirements of the dryer, the desire to keep the overall machine height as low as possible, and maintaining a wrap angle 22 of approximately 4° on the last print roller in the series. In a preferred embodiment of the present invention, therefore, the wrap angle 24 is approximately 12°.

One feature of the present invention is to configure the distance between the first printhead 14*a* and the last printhead 14*n* such that the time between the first color to print and the last color to print is minimized. For example, with a printed width of approximately 18", and a printed image comprising four colors, i.e., four printheads, and a web speed of 200 feet/minute, the time from first to last color print is desired to be not more a than three seconds.

The goal, therefore, is to have the printheads closely spaced, although it will be obvious to those skilled in the art that the size of the printheads, the number of printheads, and the avoidance of color-to-color bleed (i.e., absorption of the printed image on the coating), are clearly limitations on the spacing between printheads. It will also occur to those skilled in the art that the same spacing does not have to occur between each pair of printheads, as it is the distance between the first and last printheads that is critical. This distance, in accordance with the present invention, is based on the necessary speed of the web to achieve a quality image.

Industrial Applicability and Advantages

The present invention is useful in the field of ink jet printing, and has the advantage of improving the architecture of an electronic printing system. It is a further advantage of the present invention that it allows for multiple color printing to be achieved with excellent image quality results.

The invention has been described in detail with particular reference to certain preferred embodiments thereof, but it will be understood that modifications and variations can be effected within the spirit and scope of the invention.

What is claimed is:

1. An electronic printing system comprising:

substrate supply means for supplying a substrate along a paper path configured in an arc;

means for controllably transporting the substrate through the electronic printing system past a plurality of printheads, the printheads arranged above the paper path, in an arc configuration corresponding to the paper path configuration, to generate a printed image on the substrate;

a plurality of rollers arranged to have at least one roller under the substrate at each location corresponding to a printhead location; and dryer means located after the last of the plurality of printheads for fixing the printed image to the substrate.

2. An electronic printing system as claimed in claim 1 wherein the at least one roller at each printhead location moves with the substrate.

3. An electronic printing system as claimed in claim 1 wherein each of the plurality of rollers further comprises a wrap angle between each adjacent pair of printheads.

4. An electronic printing system as claimed in claim 3 wherein the wrap angle is less than forty-five degrees.

5. An electronic printing system as claimed in claim 3 wherein the wrap angle is in the range of two to fifteen degrees.

6. An electronic printing system as claimed in claim 3 wherein the wrap angle is approximately four degrees.

7. An electronic printing system as claimed in claim 1 wherein the roller located under the last in the plurality of printheads comprises an end wrap angle.

8. An electronic printing system as claimed in claim 7 wherein the end wrap angle is less than ninety degrees.

9. An electronic printing system as claimed in claim 7 wherein the end wrap angle is approximately twelve degrees.

10. An electronic printing system as claimed in claim 1 wherein the plurality of printheads are closely spaced.

* * * * *